United States Patent [19]

Cahill

[11] 4,117,782

[45] Oct. 3, 1978

[54] GUARD FOR PREVENTING HUMAN INJURIES ON IMPACT WITH FURNISHINGS

[76] Inventor: Richard C. Cahill, 3019 Oak Green Ct., Apt. F, Ellicott City, Md. 21043

[21] Appl. No.: 820,218

[22] Filed: Jul. 29, 1977

[51] Int. Cl.[2] ..... A47B 13/08

[52] U.S. Cl. ..... 108/27; 52/716; 248/345.1

[58] Field of Search ..... 108/27; 248/345.1; 312/137; 52/716; 297/DIG. 3

[56] References Cited

U.S. PATENT DOCUMENTS

| | | | |
|---|---|---|---|
| 1,901,377 | 3/1933 | Roe | 248/345.1 |
| 2,153,481 | 4/1939 | Ponselle | 248/345.1X |
| 2,700,196 | 1/1955 | Panhard | 52/716 X |
| 2,818,261 | 12/1957 | Morgan | 108/28 X |
| 3,105,323 | 10/1963 | Esler et al. | 52/716 X |
| 3,125,377 | 3/1964 | Bridges | 297/DIG. 3 |
| 3,181,176 | 5/1965 | Nagy et al. | 108/27 X |
| 3,357,958 | 11/1967 | Shields | 52/716 X |
| 3,869,106 | 3/1975 | Gregor | 52/716 X |
| 3,884,495 | 5/1975 | Petock | 248/345.1 X |

FOREIGN PATENT DOCUMENTS

| | | | |
|---|---|---|---|
| 1,249,271 | 11/1960 | France | 52/716 |

*Primary Examiner*—Francis K. Zugel

*Attorney, Agent, or Firm*—John F. McClellan, Sr.

[57] ABSTRACT

A removable impact guard for preventing injury to humans such as children and the infirm on striking edges of furnishings and the like comprises a self-holding elongate member for wrapping around furnishings and a securance along the elongate member for adjustably fixing the position at any degree of overlap; in embodiments both foam plastic single and plural cell inflatable tubular members are disclosed.

7 Claims, 12 Drawing Figures

GUARD FOR PREVENTING HUMAN INJURIES ON IMPACT WITH FURNISHINGS

This invention relates generally to guards and shields and specifically to an impact guard for preventing injuries caused by striking protruding corners and edges of furnishings.

Children are particularly vulnerable to injury on striking edges of coffee tables, particularly when they are tired or excited, and severe cuts and bruises occur about the head; the aged and otherwise infirm also can hurt themselves on furniture edges.

In the prior art various disclosures have been made concerning protecting humans, and also furniture, including those in the following U.S. Pat. Nos.:

4,012,878 to Ellingson, 3-22-77 discloses a double wall plastic edge guard applicable by self-adhesive;

3,869,106 to Gregov, 3-4-75, discloses a resilient trim type edge guard applicable by adhesive and removable, and reusable, and described as for preventing injury to children on furniture such as the FIG. 6 coffee table.

3,650,223 to Kobori, 3-21-72 discloses an inflated air container structure to protect humans from impact on furniture (in a vehicle) having collapsible and removable features;

3,603,535 to De Polo, 9-7-71 discloses another protective gas-containing structure for impact protection (in a vehicle) and which is inflatable from a gas source shown.

3,423,121 to Lipkin, 1-21-69, discloses deformable plural element barrier structure for impact protection in a vehicle;

3,150,584 to Jamieson, 9-29-64 discloses a body guard for temporary mounting on furniture corners and the like;

3,115,108 to Craddock et al, 12-24-63 and 1,761,223 to Roe, disclose resilient strip edge guards in furniture; and 1,331,359 to Parrott et al discloses the covering of parts with which a human is likely to collide with "an air cushion consisting of an inflatable rubber or other tube";

1,331,359 goes on to disclose resilient edging of sponge rubber in an aircraft or other vehicle.

However, it is believed that none of these disclosures fairly suggests the combination of this invention, including installation and storage aspects.

A principal object of the present invention is to provide a bodily-injury preventing adjustable, detachable easily stored buffer type guard for installation on furnishings and the like.

Still further objects are to provide a guard as described which prevents small children from dragging heavy objects, such as ashtrays, off coffee tables, and which helps limit their access to such objects, and further to provide cushioning against their falling on an edge as well as rising under an edge, and which tends to inhibit small children from venturing under low tables where they may strike sharp supports or the like.

Further objects are to provide a guard as described which is extremely simple in construction and easy to install, which cannot damage furnishings, is economical, durable and attractive in use, is free from sharp or hard installation devices, is safe for children to play around when not installed, can be used over again an indefinite number of times without losing efficiency, which holds tightest at corners and other dangerous protrusions, which fits a variety of shapes and contours, which, in embodiment can be tightened after installation by unskilled users, and which provides a choice of modes of use.

In brief summary given for purposes of cursive description only and not as limitation, the invention includes an elongate flexible guard having fastening means extending therealong on one side and therefrom, and cross-sectional shape coacting with the fastening means for securance.

The above and other objects and advantages of this invention will become more readily apparent on examination of the following description, including the drawings, in which like parts refer to like reference numerals:

FIG. 1 shows the invention 10 covering and cushioning the sharp edge of a coffee table T around the perimeter of which the invention is wrapped or looped.

In this view the invention has been made to length to fit around the coffee table and form a butt joint 22 at the ends of the flexible elongate or cushioning guard portion 20 of the invention. Proportioned for compressing the midline of the elongate member and securing it around the table with the upper and lower parts bulging over the table edge at top and bottom as shown is a flexible fastening strip 24, which preferably is "Velcro" hook fabric cemented or otherwise suitably affixed along one side of the elongate portion, along the longitudinal centerline. This extends past the end for a distance equal to two or three times the thickness of the elongate portion, and overlaps the "Velcro" on the other end, tightly and securely holding the invention on the table. For this purpose it is evident that the "Velcro" may be of the type with hooks on one side and loops on the other, or may be hook type and twisted to engage itself at the end.

The invention can be seen to form a fence extending above the table, useful in preventing heavy objects such as glass ashtray A from being dragged off the table by small children or knocked off accidentally by anyone, preventing injuries from bruising and cutting. Additionally, widespread legs L of tables may be substantially overhung by the invention, making tripping less likely.

Figure 1:
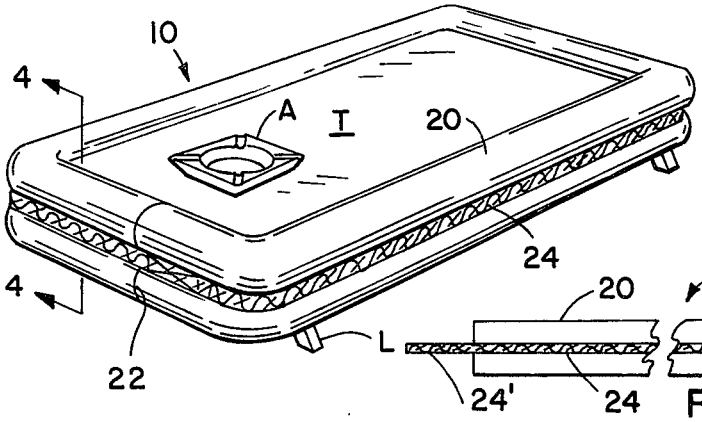
FIG. 1 is an isometric view of the invention in use on a coffee table.
Figure 2:
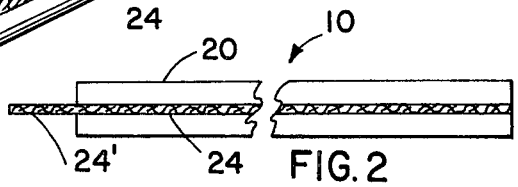
FIG. 2 is a side elevational view of the invention.

FIG. 2 shows on a reduced scale the invention 10 stretched out, illustrating the extreme simplicity of the straight elongate portion 20 and the straight length of "Velcro" 24 along it and extending at 24' beyond the end. This typifies all embodiments. The extended length is preferably quite short, making it even safer for children to play around when not installed; "Velcro" will not readily stick to eyelashes, eyelids and the like, and is more porous than tape.

Figure 3:
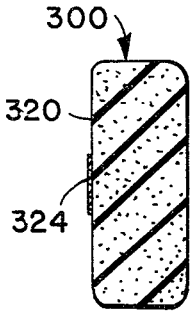
FIG. 3 is a transverse sectional view of an embodiment of the invention.

FIG. 3 shows in embodiment 300 one cross-sectional form and one material usable from among many like it, a strap of resilient polyurethane foam 320 which may be sixteen to 20 inches in circumference (40 cm to 50 cm). The "Velcro" strip 324 may be one-inch (25 mm) wide; it may be as wide as necessary in proportion to the table edge to extend slightly above and below the table edge for greater wrap and security when slack.

Figure 4:
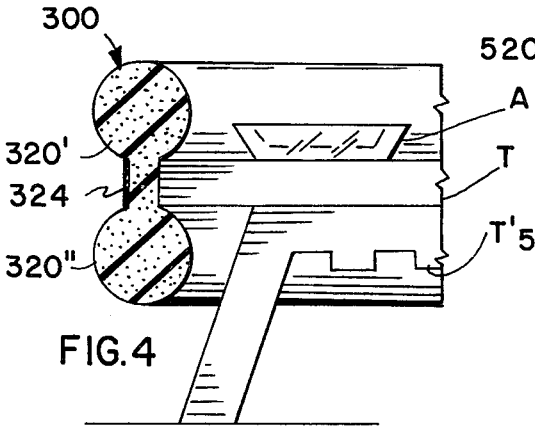
FIG. 4 is an elevational view, partly in section, adapted from 4—4, FIG. 1.

FIG. 4 shows the sectional configuration of the embodiment 300 when strapped around the edge of the typical table illustrated. Tensioning the center of the bar compresses it against the flat edge of the table, typically causing distorting bulges 320', 320'' above and below the table edge, which both overlap and grip the table, and cushion the sharp corners. It will be evident that knocks at 45° to the table whether up as in falling, or down as in an infant raising its head, will be safely received. Structure T' under the table will be to some degree covered also. Regardless of whether a large size like that pictured is used, or a smaller size is used, it can be seen that ashtrays A must be lifted over, and will not slide off or be knocked off even with the table moderately tilted. The invention in any embodiment cannot permit injury because of upside-down installation because it functions with either side up. Distortion of the cushioning materials takes up slack and assures a tight fit regardless of slight relaxation of the securance, it will be evident, in all variations.

Figure 5:
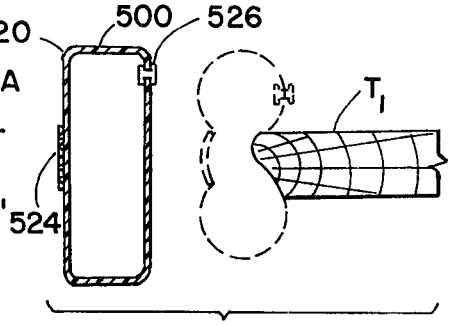
FIGS. 5 and 6 are transverse sectional views of embodiments of the invention and fragments of table.

FIG. 5 shows a further embodiment 500 of the invention, a pneumatic tube 520 with filler 526 located on the side opposite the "Velcro" strip 524. It is evident that the pneumatic tube filler may be lower than shown so that it is concealed when the unit is around a table. In the location shown it may be used for inflation after the unit is installed, further securing the unit. At the right, the broken lines show the outline configuration of this and the previous embodiment when installed on a table $T_1$ with edge contour which is acute and asymmetrical. Sectional dimensions may be four by eight inches (10cm by 20cm) in the relaxed configuration, inflated. Material may be vinyl.

Figure 6:
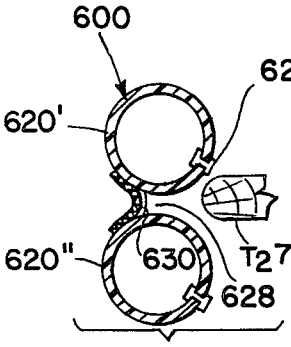

FIG. 6 shows a plural tube embodiment 600; the tubular members 620', 620'' form individual compartments, each with a filler 626. Even a table $T_2$ with a rounded edge is readily fit and clung to by this embodiment because of the longitudinal recess 628 where the two cells are suitably affixed, as by a cement strip 630.

Figure 7:
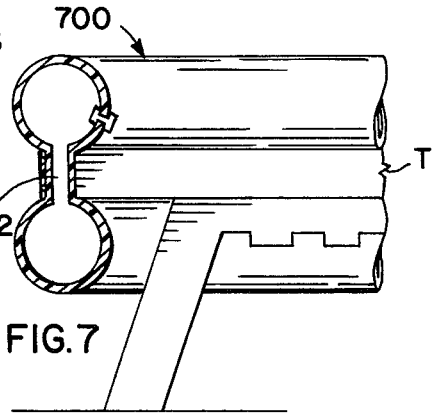
FIG. 7 is an elevational view, partly in section, similar to the FIG. 4 view.

FIG. 7 shows an embodiment 700 on guard around a table T; this is representative of the way embodiment 600 fits also. In embodiment 700 the plural tubes have at least one connection 732 between them providing for filling through a single filler.

Figure 8:
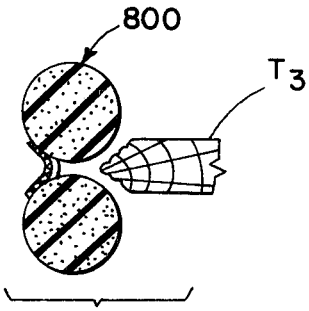
FIG. 8 is a transverse sectional view of an embodiment of the invention and a fragment of table.

FIG. 8 shows a dual strip foam embodiment 800 cemented togetheror integrally formed, and another table contour $T_3$ which is easily guarded without adaptation by this and the other embodiments.

In all the embodiments, but especially in the groove-dembodiments 600, 700 and 800, the flexible attachment strip edges are deeply recessed when installed, making tampering by small children very difficult.

Figure 9:
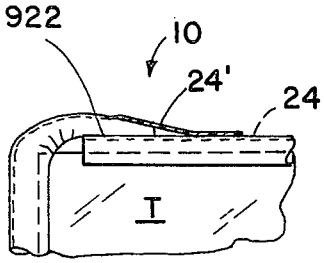
FIGS. 9 and 10 are plan view fragmentary details of respective embodiments installed on tables.

FIG. 9 illustrates an adjustable overlap 922, typical of the foam embodiments exemplified by embodiment 10, along the edge of a typical table T. If it is not desired to cut the unit to length, it can be secured as shown.

Figure 10:
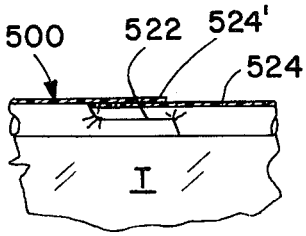

FIG. 10 shows an advantage of the pneumatic embodiments, represented by embodiment 500, the overlap area tends to fair-in when pressure is applied; it is evident that the lap can be made neatly as shown along a straight run of table.

In any embodiment the compression feature acts as a takeup, resiliently yielding to pressure and restoring, so that the connection does not loosen nor does the grip on the table, and the securing strip acts as further cushioning.

Figure 11:
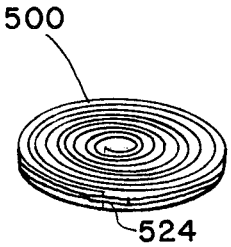
FIG. 11 is a plan view of an embodiment in storage configuration.

FIG. 11 shows a further feature of the pneumatic embodiment, represented by embodiment 500; collapsed storage configuration takes up only a small percentage of the space the foam embodiments require. The "Velcro" 524 can be used to secure the coil as indicated.

Figure 12:
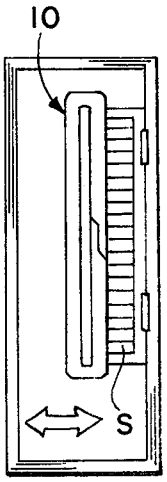
FIG. 12 is an isometric view of the invention installed on a swinging door.

FIG. 12 shows installation and use versatility of all the embodiments, indicated by embodiment 10, the swinging door S free edge may slap a small child but will not disfigure it.

From the foregoing it will be appreciated that the invention importantly provides for safe multiple re-use regardless of whether the overlap of the securing strip overlaps at a butt joint or an overlap joint; that the foam version is particularly damage-resistant, and that the pneumatic version is easily repaired using a vinyl repair kit, and that either version can be made form fitting where desired, to extend around a curve or the like.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States letters patent is:

1. In a removable impact guard for preventing injury to humans on striking the edge of a table or the like, the improvement comprising: a pneumatic tubing flexible elongate member, means for detachably attaching the pneumatic tubing flexible elongate member with ends overlapped adjustably, in a loop around a table or the like including a flexible fastening strip secured along the pneumatic tubing flexible elongate member and having a portion thereof extending beyond the pneumatic tubing flexible elongate member, the flexible fastening strip having means thereon for fastening to itself when the pneumatic tubing flexible elongate member is in a loop around a table or the like, whereby the overlapped ends tend to fair in when pressure is applied on fastening of said strip.

2. In a removable impact-guard as recited in claim 1, the pneumatic tubing flexible elongate member being strap-shaped in cross-section and the flexible fastening strip being proportioned for compressing the midsection of the pneumatic tubing flexible elongate member against a said edge of a table or the like and bulging the top and bottom of the pneumatic tubing flexible elongate member over the table or the like above and below said edges of the table or the like.

3. In a removable impact-guard as recited in claim 2, the pneumatic tubing flexible elongate member having an inflation filler.

4. In a removable impact-guard as recited in claim 1, the pneumatic tubing flexible elongate member having a recess therealong proportioned for flexibly receiving a said edge of a table or the like and the flexible fastening strip being proportioned for compressing the mid-section of the pneumatic tubing flexible elongate member against a said edge of a table or the like and holding the top and bottom of the pneumatic tubing flexible elongate member over the table or the like above and below a said edge of the table or the like.

5. In a removable impact-guard as recited in claim 4, the pneumatic tubing flexible elongate member substantially comprising in cross-section a figure-eight, with the flexible fastening strip medially along one side thereof.

6. In a removable impact-guard as recited in claim 5, the pneumatic tubing flexible elongate member comprising plural separate tubes.

7. In a removable impact-guard as recited in claim 5, the pneumatic tubing flexible elongate member comprising plural tubes with pneumatic connection therebetween.

* * * * *